US006279181B1

(12) United States Patent
Kessel

(10) Patent No.: US 6,279,181 B1
(45) Date of Patent: Aug. 28, 2001

(54) INFANT CRIB

(75) Inventor: Barnet Wolf Kessel, West Roxbury, MA (US)

(73) Assignee: West End & Hub Spring Company, Stoughton, MA (US)

( * ) Notice: Subject to any disclaimer, the term of this patent is extended or adjusted under 35 U.S.C. 154(b) by 0 days.

(21) Appl. No.: 09/321,331

(22) Filed: May 27, 1999

(51) Int. Cl.[7] ..... A47C 29/00
(52) U.S. Cl. ..... 5/99.1; 5/93.1; 5/98.1
(58) Field of Search ..... 5/99.1, 93.1, 97, 5/98.1

(56) References Cited

U.S. PATENT DOCUMENTS 2,605,482 * 8/1952 Wagoner ..... 5/99.1
2,672,627 * 3/1954 Hagelfeldt ..... 5/99.1 X
4,765,004 * 8/1988 Kessel ..... 5/99.1 X

* cited by examiner

*Primary Examiner*—Lynne H. Browne
*Assistant Examiner*—Fredrick Conley
(74) *Attorney, Agent, or Firm*—Weingarten, Schurgin, Gagnebin & Hayes LLP

(57) ABSTRACT

An infant crib in which the mattress is mounted on the frame in a secure position from which the mattress cannot be dislodged by an upward force beneath the mattress. A support panel has a plurality of straps affixed thereto which are of sufficient length to wrap around the surrounding rails or frame members of the crib and to be removably secured such as by Velcro fasteners. The mattress is placed on top of the thus secured panel. The fasteners are of sufficient strength such that when the fasteners are engaged the crib support panel can withstand a force from below the mounted panel of at least 224 pounds to meet safety standards and to prevent unintended dislocation of the crib mattress from its operative disposition. The invention can be embodied in a permanent crib structure or in a portable crib structure. The invention can also be embodied in a playpen or other infant furniture in which a mattress is to be secured.

10 Claims, 3 Drawing Sheets

INFANT CRIB

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

Infant cribs must be designed and constructed to provide a safe environment for the infant and to meet various government safety standards. Such safety standards have become increasingly more stringent over the years as concern about child safety has risen in public awareness. Standards exist for example with respect to the spacing between the slats of crib sides, and the mesh sizes acceptable for the sides of portable folding cribs or playpens. Standards also exist as to acceptable materials and their strength and flammability characteristics for crib construction. A relatively new standard has been propounded in Canada and has been proposed in the United States and other countries which requires that the mattress of a crib be able to withstand an upward force beneath the mattress of a minimum of 224 pounds such as could occur by an older child playing beneath the crib or from a dog moving below the crib or from some other inadvertent upward force applied to the bottom of the mattress of its support. Such an unintended upward force could dislocate the mattress and could eject the infant from the crib or otherwise cause harm to the child.

BRIEF SUMMARY OF THE INVENTION

The present invention provides an infant crib in which the mattress is mounted on the frame in a secure position from which the mattress cannot be dislodged by an upward force beneath the mattress. A support panel has a plurality of straps affixed thereto which are of sufficient length to wrap around the surrounding rails or frame members of the crib and to be removably secured such as by Velcro fasteners. The straps should be as short as practicable to minimize the potential danger to infants by loose straps. The mattress is placed on top of the thus secured panel. The fasteners are of sufficient strength such that when the fasteners are engaged the crib support panel can withstand a force from below the mounted panel of at least 224 pounds to meet safety standards and to prevent unintended dislocation of the crib mattress from its operative disposition. The invention can be embodied in a permanent crib structure or in a portable crib structure. The invention can also be embodied in a playpen or other infant furniture in which a mattress is to be secured.

DETAILED DESCRIPTION OF THE INVENTION

Figure 1:
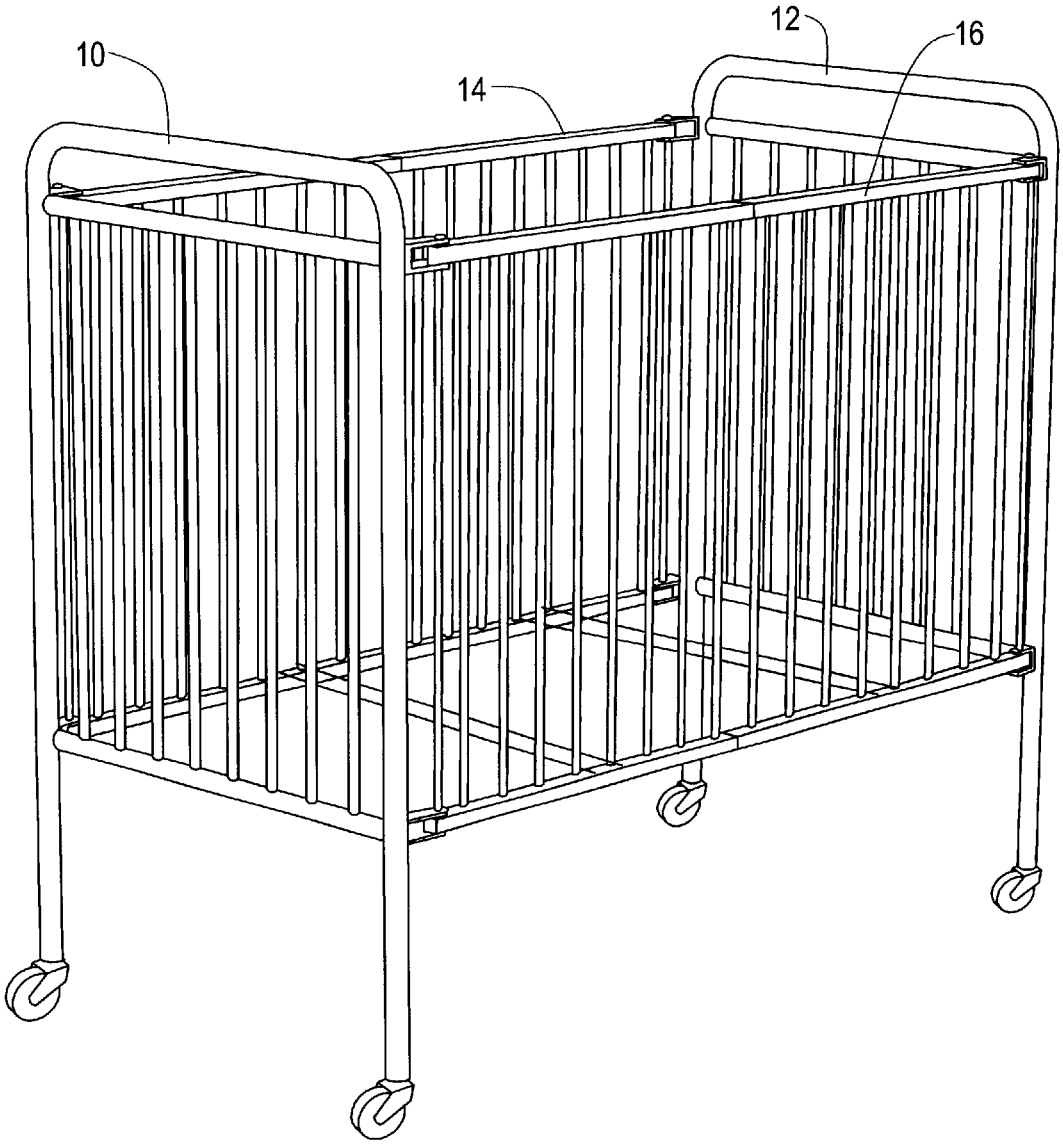
FIG. 1 PRIOR ART
FIG. 1 is a pictorial view of a folding crib of known construction.

FIG. 1 shows a folding crib of known construction and of one type with which the present invention is useful. The crib is composed of end units 10 and 12, and side frames 14 and 16 each of which is pivotably attached to the end units by pivot connections 18. Each of the sides is also hinged at the center of the horizontal rails to allow the sides to be folded inward. Two metal support bars 22 are disposed across the width of the crib and are hooked onto the lower rails 23 of the sides by end fittings 24. These bars serve to keep the crib in an open position and to act as supports for the floorboard which rests on the top of the bars and which may be riveted or otherwise attached to the bars. The folding crib may be constructed as shown in U.S. Pat. No. 4,765,004. In the absence of the invention, this prior art crib construction suffers from the floorboard being held in place only by gravity such that an upward force below the floorboard can dislodge the floorboard and a mattress disposed thereon with possible injury to an infant resting on the mattress.

Figure 2:
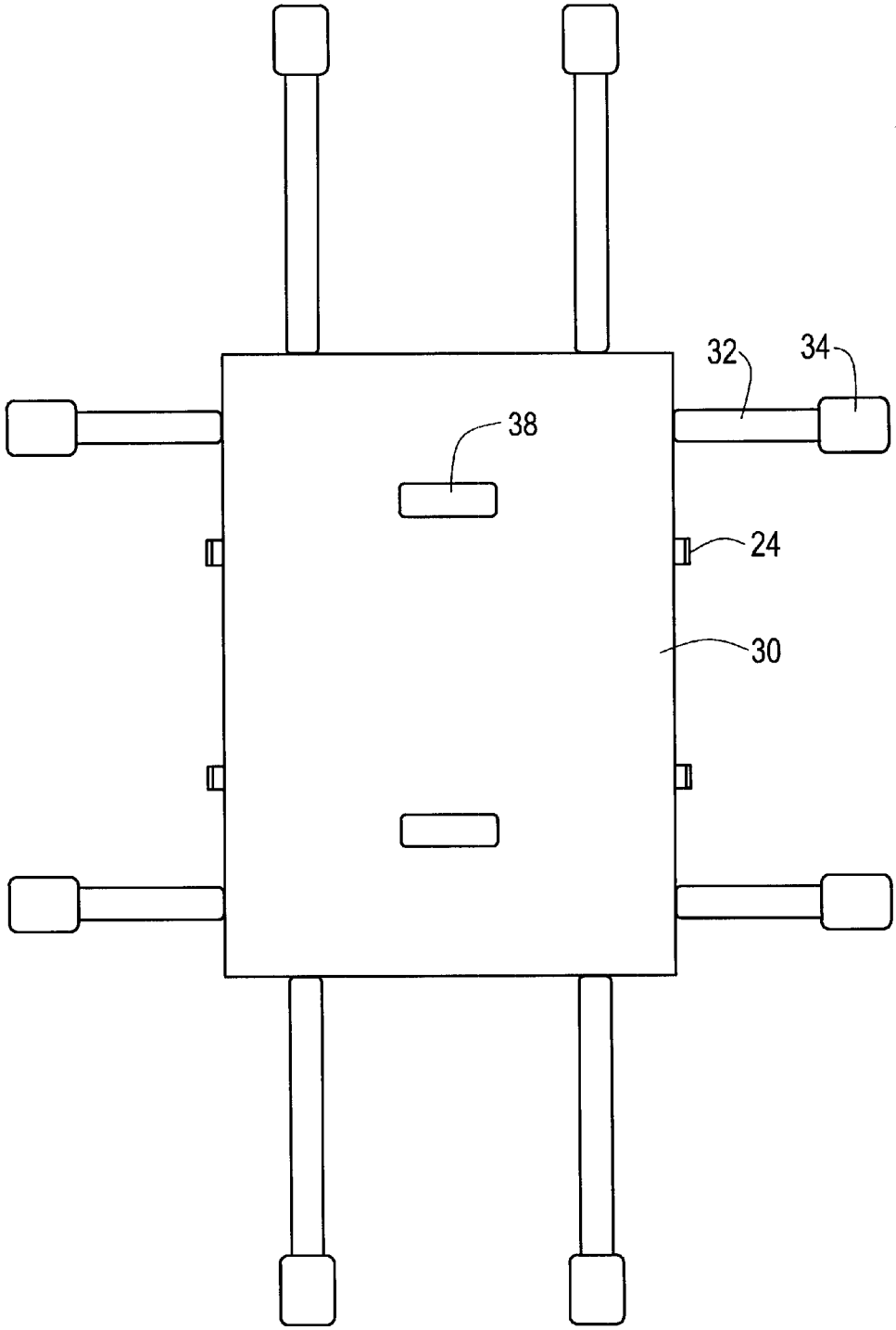
FIG. 2 is a top view of a crib floorboard illustrating the straps in unlocked position.
Figure 4:
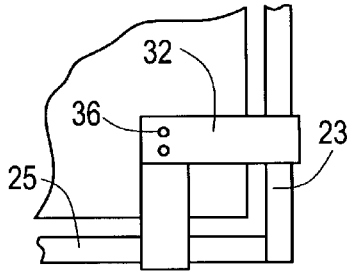
FIG. 4 is a cutaway bottom view of the floorboard in locked position.

A floorboard or mattress support panel in accordance with the invention is shown in top view in FIG. 2. The floorboard can be affixed to the support bars such as by rivets. The floorboard includes a rectangular panel or sheet 30 having straps or webs 32 secured to the bottom of the sheet, as in FIG. 4, and having releasable fasteners 34 on the outer ends thereof. In the illustrated embodiment the straps 32 are of a fabric, such as polypropylene, one end of which is secured to the panel by rivets or other suitable fastening elements or by a suitable adhesive. The releasable fasteners are preferably hook and loop fasteners such as Velcro fasteners. The two openings 38 in the panel are hand holes for use in installing and removing the floorboard during set-up and folding of the crib.

Figure 3:
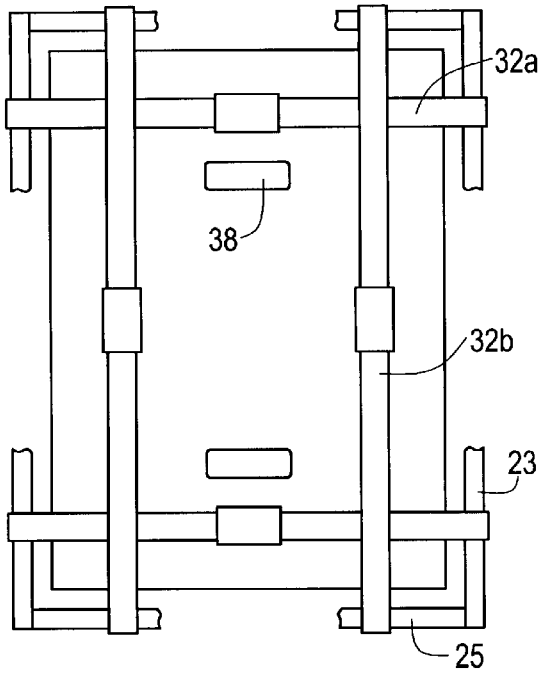
FIG. 3 is a top view of a crib floorboard with the straps in a locked position.

To install the floorboard in the crib, the board is placed on the support bars 22, the flexible straps 32*a* extending from the longer sides of the floorboard are wrapped over the bottom horizontal rails of the sides and the end fasteners 34 are locked to each other as illustrated in FIG. 3. If the bars 22 are affixed to the floorboard, the floorboard and attached bars are placed as a unit into the frame, with the end fittings of the bars hooked onto the lower rails. The flexible straps 32*a* extending from the longer sides of the panel are wrapped over the bottom rails 23 of the sides, and the fasteners are locked together as shown in FIG. 3. The flexible straps 32*b* extending from the shorter sides of the panel are wrapped over the bottom rails 25 of the end units, and the fasteners are locked together as shown in FIG. 3. The floorboard is secured in place by the straps cooperating with the bottom rails of the crib such that the floorboard can withstand a substantial upward force without becoming dislocated. A mattress (not shown) placed on the floorboard is similarly retained in place since the supporting panel on which the mattress rests is substantially immovable.

The crib can be easily folded by unlocking the fasteners 34, removing the floorboard and supporting bars and then folding the crib sides in conventional fashion.

Figure 5:
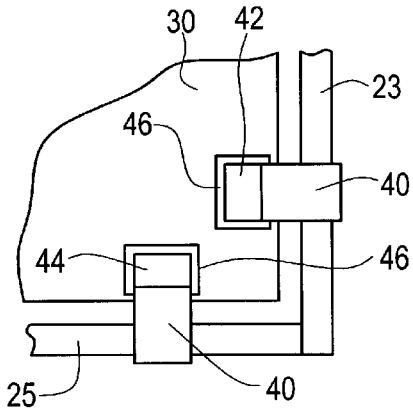
FIG. 5 is a top bottom view of an alternative embodiment.

An alternative embodiment of the floorboard is shown in FIG. 5 which is a cutaway top view of a corner of panel or floorboard 30. The straps 40 are affixed such as by rivets 36 to the bottom of the floorboard panel as shown above in FIG. 4. In this version the straps are shorter than in the above described embodiment and are folded around the bottom rails 23 and 25 of the crib, and the end fasteners 44 of each pair of straps are connected to cooperative fasteners 46 which are affixed to the top surface of the floorboard. The fasteners 44 and 46 can be Velcro type fasteners or other known strap fasteners.

Figure 6:
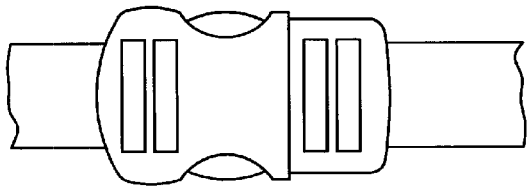
FIG. 6 is a plan view of a snap fastener useable in the invention.

The releasable fasteners can be of many different types. In addition to the Velcro style fasteners described above, the fasteners can be of the interlocking plastic type such as shown in FIG. 6. Other types of fasteners, which are per se know, can be employed.

The floorboard typically measures 22 inches by 44 inches and is composed for example of a lignin bonded hardwood ¼ inch thick. The board can be constructed of other materials having sufficient strength.

While the invention has been shown in conjunction with a folding crib, it will be appreciated that the invention is also useful in cribs of non-folding construction and also useful in playpens and other infant and childrens' furniture in which a bottom panel is to be secured and locked against unintended dislocation.

The invention is not to be limited by what has been particularly shown and described as variations and alternative implementations may occur to those skilled in the art without departing from the spirit and true scope of the appended claims.

What is claimed is:

1. An infant crib comprising:

a frame having a pair of end units and a pair of sides connected to the end units to form a rectangular enclosure;

each of the end units and sides having a bottom rail disposed in a common horizontal plane;

a floor structure including:

a plurality of support bars having end fittings for attachment to the bottom rails of the sides;

a rigid floorboard supported on the support bars and disposable within the frame to provide a floor for the enclosure;

a plurality of elongated flexible straps disposed about the periphery of the floorboard, each of the straps having a first end affixed to a respective portion of the floorboard and a second movable end;

a plurality of first fasteners each attached to the second end of selected ones of the straps;

a plurality of second fasteners cooperative with the first fasteners;

each of the straps having a length to permit wrapping around an adjacent portion of the bottom rails and removable attachment of the first fasteners to a cooperative one of the second fasteners to removable lock the floorboard to the frame.

2. The infant crib of claim 1 wherein the support bars are attached to the floorboard and wherein the end fittings of the support bars outwardly extend from the floorboard to a position attachable to the bottom rails.

3. The infant crib of claim 1 wherein the first end of each strap is fastened to the floorboard at a respective position about the periphery thereof.

4. The infant crib of claim 1 wherein the pair of sides are each composed of two sections pivotably interconnected to permit the frame to be folded in the absence of the floorboard and support bars.

5. The infant crib of claim 1 wherein the first and second fasteners are hook and loop type fasteners.

6. The infant crib of claim 1 wherein the first and second fasteners are snap fasteners.

7. The infant crib of claim 1 wherein the straps are wrapped around adjacent portions of the bottom rails and folded over the floorboard where the first and second fasteners are connected to cooperative fasteners on the floorboard.

8. The infant crib of claim 1 wherein the straps include a pair of straps extendible from the side edges of the floorboard near each corner and which are wrappable around adjacent portions of the bottom rails;

and wherein a second fastener on each end of the pair of straps is cooperative with a first fastener attached to the floorboard.

9. The infant crib of claim 1 wherein the second fasteners are each attached to the second end of selected other ones of the straps;

and wherein the first and second fasteners are connected after wrapping of the associated straps around the bottom rails.

10. An infant crib comprising:

a frame having a pair of end units and a pair of sides connected to the end units to form a rectangular enclosure;

each of the end units and sides having a bottom rail disposed in a common horizontal plane;

a floor structure including:

a plurality of support bars having end fittings for attachment to the bottom rails of the sides;

a rigid floorboard supported on the support bars and disposable within the frame to provide a floor for the enclosure;

a plurality of elongated flexible straps disposed about the periphery of the floorboard, each of the straps having a first end affixed to a respective portion of the floorboard and a second movable end, the straps including:

a first group of straps extendible from one of the pair of sides;

a second group of straps extendible from the other of the pair of sides;

a third group of straps extendable from one of the pair of end units;

a fourth group of straps extendable from the other of the pair of end units;

a plurality of first fasteners each attached to the second end of respective ones of the first and third straps;

a plurality of second fasteners cooperative with the first fasteners each attached to the second end of respective ones of the second and fourth straps;

each of the straps having a length to permit wrapping around an adjacent portion of the bottom rails and removable attachment of the first fasteners to a cooperative one of the second fasteners to removably lock the floorboard to the frame.

* * * * *

UNITED STATES PATENT AND TRADEMARK OFFICE

CERTIFICATE OF CORRECTION

PATENT NO. : 6,279,181 B1
DATED : August 28, 2001
INVENTOR(S) : Barnet Wolf Kessel It is certified that error appears in the above-identified patent and that said Letters Patent is hereby corrected as shown below:

Column 3,
Line 50, “removable” should read -- removably --;

Column 4,
Line 13, “extendible” should read -- extendable --;
Line 42, “extendible” should read -- extendable --; and
Line 44, “extendible” should read -- extendable --.

Signed and Sealed this

Thirtieth Day of July, 2002

*Attest:*

*Attesting Officer*

JAMES E. ROGAN
*Director of the United States Patent and Trademark Office*